United States Patent [19]

Lacoste et al.

[11] 4,022,469

[45] May 10, 1977

[54] TENNIS BALL

[75] Inventors: Francois René Lacoste, Neuilly; Jean Marc Warnery, Boulogne, both of France

[73] Assignees: Patentex S.A., Fribourg; Ciba-Geigy AG, Basel, both of Switzerland

[22] Filed: May 12, 1975

[21] Appl. No.: 576,937

[30] Foreign Application Priority Data

May 18, 1974 Switzerland ..... 6799/74

[52] U.S. Cl. ..... 273/61 C; 273/DIG. 10; 260/852; 260/265; 273/DIG. 8

[51] Int. Cl.[2] ..... A63B 39/02

[58] Field of Search ..... 273/61 R, 218, 61 C, 273/58 J, DIG. 8, DIG. 10

[56] References Cited

UNITED STATES PATENTS

| | | | |
|---|---|---|---|
| 2,896,949 | 7/1959 | Dunker | 273/61 C |
| 3,238,156 | 3/1966 | Kohrn | 273/218 X |
| 3,428,315 | 2/1969 | Haines | 273/61 R |
| 3,553,115 | 1/1971 | Curchod et al. | 260/3 |

*Primary Examiner*—George J. Marlo
*Attorney, Agent, or Firm*—Luther A. R. Hall

[57] ABSTRACT

The invention provides tennis balls which comply in their behavior with the requirements of the "Rules of the International Lawn Federation" and which consist wholly or partially of a rubber based on natural and/or synthetic rubber which contains 15 to 50 parts by weight of a finely powdered aminoplast resin with a specific surface area of >5m²/g. Suitable fillers for the rubber are urea/formaldehyde and melamine/formaldehyde polycondensation products. The tennis balls according to the invention can either have an internal gas pressure of 1.4 to 2.3 kg/cm² (absolute) or they can be non-inflated, i.e. internally they have atmospheric pressure. The good behavior of these tennis balls is retained over an extended period of play. The tennis balls according to the invention are either provided with a textile or felt covering or they have no covering.

21 Claims, 3 Drawing Figures

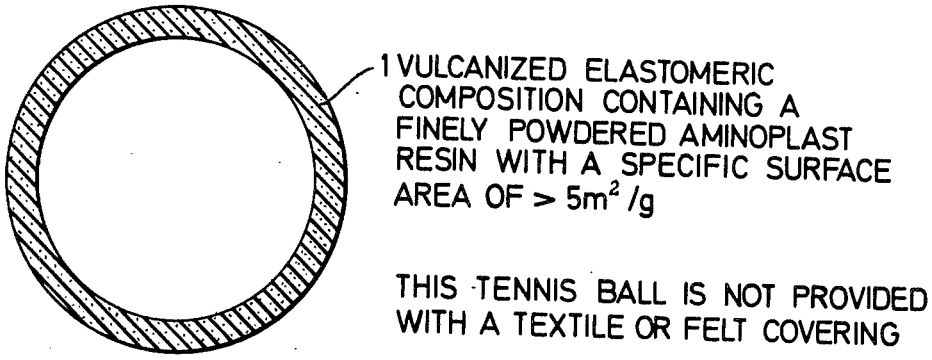

Fig. 1

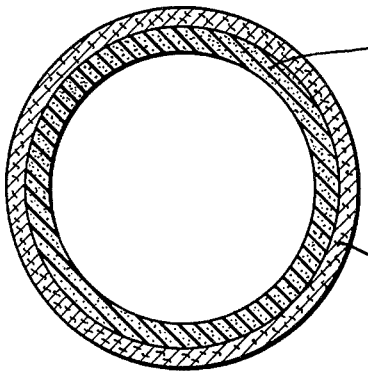

1 VULCANIZED ELASTOMERIC COMPOSITION CONTAINING A FINELY POWDERED AMINOPLAST RESIN WITH A SPECIFIC SURFACE AREA OF > $5m^2/g$

3 FELT COVERING OR TEXTILE COVERING

Fig. 2

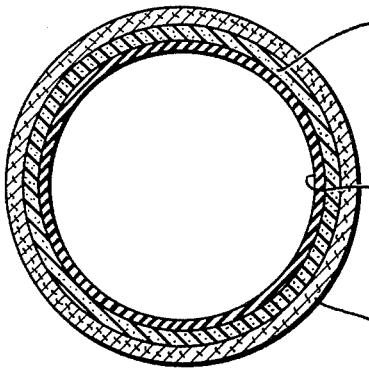

1 VULCANIZED ELASTOMERIC COMPOSITION CONTAINING A FINELY POWDERED AMINOPLAST RESIN WITH A SPECIFIC SURFACE AREA OF > $5m^2/g$

2 VULCANIZED ELASTOMERIC COMPOSITION CONTAINING NO AMINOPLAST RESIN

3 FELT COVERING OR TEXTILE COVERING

Fig. 3

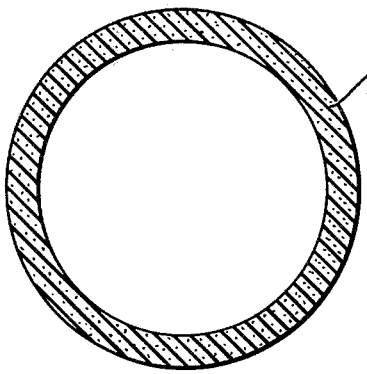

1 VULCANIZED ELASTOMERIC COMPOSITION CONTAINING A FINELY POWDERED AMINOPLAST RESIN WITH A SPECIFIC SURFACE AREA OF > $5m^2/g$

THIS TENNIS BALL IS NOT PROVIDED WITH A TEXTILE OR FELT COVERING

TENNIS BALL

Tennis balls which are used in the tournaments recognised by the major national organisations must comply with specific regulations of the International Lawn Tennis Federation.

Details of the requirements made of a tennis ball are inter alia:

A. The diameter of the ball must be between 6.35 and 6.68 cm (2½ to 2⅝ ins) under specific temperature and humidity conditions.

B. The weight of the ball must be between 56.70 and 58.47 g (2 to 2 1/6 ounces).

C. When dropped from a height of 2.54 m (100 ins) onto a concrete base, the ball shall have a bound of 1.346 to 1.473 m (53 to 58 ins).

D. Given tolerances may not be exceeded in respect of the deformation of the tennis ball of a specific weight (from rest and after it has been compressed with considerable force).

These deformations, which are ascertained with the aid of a special Stevens machine, provide more precise information on the behaviour of the ball which results from the mechanical deformation thereof caused by the racket.

The details of the deformation tests carried out with the Stevens machine are as follows:

In the first test to determine the deformation of the ball from rest (deformation or "forward deformation"), the tennis ball is compressed with a weight of 8.165 kg (18 lbs) and the resultant deformation is measured. The forward deformation may be between 5.59 and 7.37 mm (0.22 to 0.29 ins). (Earlier tolerances 6.73 to 7.37 mm). In the second test for determining the deformation after preliminary compression with a heavy weight, the procedure is as follows. First, the tennis ball is compressed with such force, while maintaining specific conditions, that the deformation is 25.4 mm (1 inch). Then the compression is reduced to a weight of 8.165 kg (as in the forward deformation). The deformation that now results is greater on account of the greater previous compression. This is called "return deformation," and, according to the regulations, must be between 8.89 and 10.8 mm (0.35 mm and 0.425 ins). All tests for determining the deformation are carried out in three directions at right angles to each other.

Most of the tennis balls used today are still inflated balls the internal pressure of which is greater than the atmospheric pressure. Even before the Second World War, initial experiments were carried out to manufacture non-inflated tennis balls, i.e. with internal atmospheric pressure. But it was not until after 1950 that this development resulted in some success. At the present time, besides the conventional tennis balls with internal super-atmospheric pressure, a limited number of balls of normal pressure are already being sold and used. In this connection, attention is drawn to the following relevant patents: U.S. Pat. Nos. 2,896,949, 3,428,314, 3,428,315 and 3,432,165. The first of these patents claims a tennis ball having a gas filling at atmospheric pressure and consisting of rubber and containing a styrene-butadiene copolymer with high styrene content in at least one annular layer. The three other more recent patents claim pressureless tennis balls made from rubber compositions derived from natural or synthetic rubber and containing as special reinforcing filler wood flour, a curable phenol-formaldehyde resin and an acrylonitrile-butadiene-styrene copolymer resin (ABS) or a polypropylene.

However, all tennis balls in use at the present time, i.e. both the inflated balls and those with internal atmospheric pressure, still exhibit considerable disadvantages. It is common knowledge, for example, that after a relatively short time the internal pressure of the conventional tennis ball with a specific super-atmospheric pressure decreases to such an extent that the readings obtained with the Stevens machine are no longer within the permitted tolerances. The rebound accordingly diminishes also and the balls which are so altered in their basic characterisics are no longer suitable even for normal tennis playing.

In order to inhibit for as long as possible the decrease in the bounce of these tennis balls as a result of the diffusion of the gas contained in the interior through the rubber wall, the balls are today usually still kept and dispatched in metal containers under super-atmospheric pressure. The container is opened on the tennis court only shortly before use. This kind of packing too must also be cited as a particular disadvantage of these conventional tennis balls.

The non-inflated tennis balls naturally do not have the disadvantage that their properties change owing to the decrease in the super-atmospheric pressure. However, other problems which to date it has not been possible to finally resolve arise instead. For example, it has turned out that whereas it has been possible to manufacture balls of atmospheric pressure which comply with the regulations of the International Lawn Tennis Federation, these same balls have not been able to fulfil the requirements demanded of them in actual play. The players considered these balls to be altogeher too soft.

In the course of further development, non-inflated, harder balls which were held by the players to be more agreeable and more suitable were then manufactured. But these balls had other drawbacks: they did not meet the requirements of the Stevens deformation test. The forward deformation was consistently below 6.73 mm, the then lower limit of tolerance. In addition, these balls had the disadvantage that the initial hardness and resistance to deformation decreases in the course of the game, especially under the influence of forceful strokes.

It is particularly significant that, after some years of discussion, the tennis authorities modified and supplemented the regulations. In particular, the lower limit of the forward deformation according to Stevens was lowered from 6.73 to 5.59 mm. This measure then permitted the use of tennis balls with a somewhat higher internal pressure, which in effect meant a longer possible playing time (with slowly decreasing pressure).

Furthermore, it was laid down as a new test condition that the deformation tests of Stevens shall be carried out within less than 2 hours after 9 deformations (compressions) under considerable stress. This condition took into account in particular the behaviour of the noninflated tennis balls, since the initially relatively high strength of these balls is diminished by this deformation just as it is by the first repeated strokes in play.

On top of this, the second deformation test already mentioned hereinbefore (the return deformation) was then introduced (especially with respect to noninflated balls). This special regulation straightaway disqualifies balls which suffer too great a change in their deformation behaviour after the first repeated strokes in play.

Table I reports the results of the deformation tests of Stevens which were carried out with the best known tennis balls developed to date. The diagram contained therein illustrates the deformation tolerance (forward deformation; the area on the left) and the return deformation tolerance (return deformation; the area on the right). The individual test is characterised by a horizontal line. This line results in each case from the combination of both values (average values of the pointer deflections) of deformation and return deformation. The test may be called positive when the horizontal line always finished within the two tolerances. The difference between the forward and return deformation is indicated on the right next to the diagram.

According to Table I, the inflated tennis balls of makes D and S satisfy the requirements of the Stevens test. But the test results do not make it evident that this favourable deformation behaviour of the newly manufactured and used balls becomes considerably worse after a few weeks.

The non-inflated balls under investigation are of three types. The first group comprises hard balls which comply fully with the regulations when new. The second group comprises softer types which are no longer fully within the forward deformation tolerance and are therefore not suitable as playballs. The third group comprises those balls which in general are regarded as the best of the non-inflated balls used up to now. They are very hard and in this regard are at the limit of the tolerance; the lower limit of the forward deformation is partially reached.

It is striking that, in comparison to the inflated balls, all non-inflated balls show considerable differences between deformation and return deformation. The matter of the difference between the deformation and return deformation has been discussed in detail by the International Federation. This phenomenon, which has been not quite correctly described as "permanent deformation", results in the energy which corresponds to the deformation caused by the racket not being converted completely and not quickly enough into kinetic energy (i.e. into the initial speed of the ball).

It is evident that this great difference between deformation and return deformation observed in the noninflated tennis balls developed so far is very disadvantageous, especially as this difference increases quite substantially after only a few games (e.g. from 3.81 mm to 4.32 and even up to 5.08 mm).

It is the object of the invention to develop a tennis ball which has none of the faults of the tennis balls discussed herein according to the prior art. The ball will consist of a material which is as impermeable to gas and air as possible. It will not be necessary to pack the balls in pressurised containers. In particular, the ball will possess very special properties in respect of its elastomer composition and will thereby comply to the maximum possible extent with the regulations of the International Lawn Tennis Federation. The deformation behaviour will be within the required tolerances and remain constant for as long as possible. The ball must have the necessary rebound behaviour. The difference between deformation and return deformation will be as small as possible.

The invention is based on the surprising observation that it is possible to obtain particularly useful tennis balls with a relatively constant and good play behaviour by using for the manufacture a rubber which contains as filler a finely powdered aminoplast resin with a specific surface area of > 5 $m^2/g$. It is the precise object of the invention to provide a hollow tennis ball which is optionally provided with a textile or felt covering, and the weight, diameter, rebound and deformation behaviour of which comply with the requirements of the "Rules of the International Lawn Tennis Federation" of 1972 and which consists substantially of a rubber based on natural and/or synthetic rubber, wherein the entire rubber, or at least a layer thereof comprising the hollow sphere, contains in substantially homogeneous distribution 15 to 50 parts by weight of a finely powdered aminoplast resin with a specific surface area of > 5 $m^2/g$ to 100 parts by weight of the respective elastomer or elastomeric mixture.

The accompanying drawings illustrate several embodiments of tennis balls in accordance with the present invention. FIGS. 1 to 3 inclusive show cross-sections of tennis balls in accordance with the invention.

In FIG. 1, the tennis ball comprises a self-supporting hollow sphere 1 being made of a vulcanized elastomeric composition containing in substantially homogeneous distribution a finely powdered aminoplast resin with a specific surface area of > 5 $m^2/g$. A surface layer or covering 3 of felt or textile is applied to said hollow sphere.

In FIG. 2, the tennis ball comprises a dual layered hollow sphere wherein the inner layer 2 is made of a vulcanized elastomeric composition containing no aminoplast resin filler and the outer layer 1 is made of a vulcanized elastomeric composition containing in substantially homogeneous distribution a finely powdered aminoplast resin with a specific surface area of > 5 $m^2/g$. A surface layer or covering 3 of felt or textile is applied to said dual layered hollow sphere.

In FIG. 3, the tennis ball comprises a self-supporting hollow sphere 1 being made of a vulcanized elastomeric composition containing in substantially homogeneous distribution a finely powdered aminoplast resin with a specific surface area of > 5 $m^2/g$. In this embodiment of the invention no felt or textile covering is needed.

The aminoplast resins contained in the rubber are in particular urea/formaldehyde and melamine/formaldehyde polycondensation products as well as the corresponding polycondensation products which can be manufactured by condensation with other polymer formers. Examples of such suitable comonomers which are able to form polycondensates with formaldehyde or methylol compounds are: thiourea, dicyandiamide, benzoguanamine, aniline, phenol and alkylphenols. Mixtures of such urea/formaldehyde and melamine/formaldehyde polycondensation products and, if appropriate, corresponding copolycondensates, are also suitable according to the invention as fillers for the rubber.

Particularly good tennis balls according to the invention are obtained if the rubber mixtures used for the manufacture thereof contain a urea/formaldehyde condensation polymer modified by sulpho groups as aminoplast resin. aminoplast resins with a specific surface area of 25 to 120 $m^2/g$, preferably from 30 to 120 $m^2/g$, results in very useful balls. Specific surface areas greater than 50 $m^2/g$ likewise constitute a preferred embodiment of the aminoplast resins used herein.

A content of 15 to 35parts by weight to 100 parts by weight of the respective elastomer or elastomeric mixture is preferred for textile covered balls in respect of the concentration of the aminoplast resin in the rubber. For uncovered tennis balls a content of 30 to 50 parts by weight to 100 parts of rubber or rubber mixture is preferred.

The aminoplast resins contained in the rubber of the tennis ball according to the invention can be manufactured by different processes. The best known processes are protected by or described in the following patents: U.S. Pat. Nos. 3,509,098, 3,553,115, 3,428,607, French Pat. Nos. 2,004,360, 2,059,767 and 2,057,981.

In this connection, attention is drawn to the following publications in which aminoplast resins are dealt with:

A. Renner "Hochdisperse, vernetzte Kondensationspolymere aus Melamin und Formaldehyde" in "Die Makromolekulare Chemie" 120 (1968) 68–86, and A. Renner "Kondensationspolymere aus Harnstoff und Formaldehyde mit grosser spezifischer Oberflache" in "Die Makromolekulare Chemie" 149 (1971, 1–27.

The urea/formaldehyde condensation polymers which are modified by sulpho groups mentioned hereinbefore can be best manufactured by a newly proposed process. This process consists in polycondensing a precondensate (V) of urea and formaldehyde and a condensation polymer (N) of naphthalenesulphonic acid and formaldehyde in aqueous solution at temperatures of 20° to 100° C in such a quantity ratio to a gel that the molar ratio of formaldehyde to urea in the reaction mixture at the moment of the gel formation is 1.25 to 2, whereby at these molar ratios both the free monomeric starting products (formaldehyde and urea) and those bonded in the primary products are to be taken into consideration, and, if desired, in comminuting the resultant gel, suspending it, if desired neutralising the suspension and filtering it, drying the filter residue and deagglomerating the resultant product in a mill or processing it to granules, preferably by extrusion.

This process yields highly disperse, solid urea/formaldehyde condensation polymers which contain sulpho groups and which consist of compact, spherical, agglomerated primary particles with a diameter smaller than 1 um and has a specific surface area of 5 to 100 $m^2/g$, preferably 60 to 70 $m^2/g$.

In this novel process, the condensation polymer (N) will preferably be present in the reaction mixture in such an amount that there are 10 to 150 milligram equivalents of the group $—SO_3H$ to 1 mole of urea. In general, particularly good results are obtained when there are 20 to 50 milligram equivalents of the group $—SO_3H$ to 1 mole of urea.

The concentration of the aqueous reaction mixture in respect of the sum of precondensate (V) and condensation polymer (N) will preferably be 15 to 40 percent by weight (based on the solution). Particularly good polymers are obtained at a concentration of 20 to 25 percent by weight.

The manufacture of the precondensates (V) is effected by known processes by condensation of formaldehyde and urea in aqueous solution. Preferably those precondensates (V) are used which contain formaldehyde and urea in the molar ratio of 1.3 to 1.8 and those which have been manufactured by precondensation of the reaction components in the pH range of 6 to 9 and in the temperature range of 20° to 100° C.

The condensation polymer (N) will contain the components preferably in such quantity ratios that there are 0.7 to 2.2 moles of formaldehyde to 1 mole of naphthalenesulphonic acid. The best results are obtained if the molar ratio of formaldehyde to naphthalenesulphonic acid is 1.0 to 1.5.

Particularly good tennis balls are also obtained by using rubber mixtures which contain as aminoplast resin a urea/formaldehyde polycondensation product which has been manufactured by the process according to French Pat. No. 2,004,360. Such products consist usually of agglomerates of approximately spherical primary particles with an average diameter of < 1000A, preferably of about 500A. The diameter of the agglomerates varies. Agglomerates with average particle sizes between 7 and 15$\mu$m are highly suitable as filler for the elastomeric composition of the tennis balls according to the invention. The narrower preferred range is up to 8 to 11$\mu$m. These fillers are substantially no longer present in the form of the original agglomerates in the elastomeric composition but as isolated primary particles or in the form of smaller agglomerates.

According to a preferred embodiment of the invention, the aminoplast resin in the rubber of the tennis ball can be replaced to an amount of up to about 30 percent by weight by a conventional filler for rubber, preferably by kaolin. Good results are obtained for example if a urea/formaldehyde resin and kaolin are present in the rubber in the weight ratio of 6:1.

The tennis ball according to the invention consists preferably of a rubber which contains natural rubber as basic elastomer. In principle, however, synthetic rubbers and mixtures of synthetic rubbers and mixtures of synthetic rubbers with natural rubber can also be used for the tennis ball. Mixtures of natural rubber and polybutadiene which contain up to 50 parts of polybutadiene for 50 parts of natural rubber are particularly suitable.

According to the invention, there exists inside the tennis ball either atmospheric pressure or else an absolute pressure of about 1.4 to 2.3 $kg/cm^2$, preferably 1.4 to 1.8 $kg/cm^2$. The invention also concerns both noninflated balls as well as those with super-atmospheric pressure in their interior.

As a general rule, the tennis ball according to the invention is provided with the conventional textile or felt covering.

The tennis balls according to the invention are manufactured by the conventional known methods. It is therefore superfluous to provide a detailed description of these methods.

The tennis ball according to the invention does not have the disadvantages already discussed of the known tennis balls. The preferred embodiment of the noninflated ball is fully within the tolerances of the Stevens test. It is to be singled out as a particular advance in the art that the difference between deformation and return deformation is surprisingly small. It is between 2.9 and 3.3 mm, whereas this difference in the case of conventional noninflated tennis balls is between 3.55 and 5.08 mm. This tennis ball also meets all other requirements contained in the Rules of the International Lawn Tennis Federation. The bound is therefore also sufficiently high and it is not necessary to pack the balls in pressurised metal containers.

Very exacting standards were set in solving the task of the invention. It was not sufficient that some particular property of the rubber composition of which the tennis ball consists was particularly superior. The problem was more complex, for on the one hand a favourable equilibrium of a number of properties of the rubber composition had to be found, and on the other hand this equilibrium had to be adjusted to the pressure within the ball. That it was not easy to solve this task of developing tennis balls with the desired optimum play behaviour can be inferred from the fact that such tests have been carried out for many years and that the International Lawn Tennis Federation has been virtually prepared to modify the regulations for the purpose of promoting new developments in this direction. (This accomodating attitude on the part of the Federation also underlines in particular the urgency of solving the problem and the need for improved tennis balls).

It must be considered particularly surprising in this connection that it has been possible to solve the task of the invention in such a simple and elegant fashion, viz. by using special, finely powdered aminoplast resins as reinforcing fillers for the rubber composition of which the shell of the tennis ball consists. It is particularly surprising that these aminoplast resins are suitable both for pressureless balls and for balls with super-atmospheric pressure.

Examples

A. Rubber Compositions for Tennis Balls

Using a mixer roller, different rubber mixtures suitable for the manufacture of the tennis ball according to the invention are prepared by known methods. The resin types I to VIII which are more closely characterised in Table II are used as finely powdered aminoplast resins. These are the urea/formaldehyde resins I, II, III, V, VI and VIII which have been manufactured by the process of French Pat. No. 2,004,360,the urea/formaldehyde resin VII which is modified by sulpho groups and the malamine/formaldehyde resin IV which has been manufactured by the process of U.S. Pat. No. 3,509,098.

Table II

| No. | resin type | specific surface area m²/g | average diameter of the agglomerates in μm | % of agglomerates of more than 10 μm | % of agglomerates of more than 40 μm | average diameter of the primary particles in A | powder density in g/l | density in g/ml |
|---|---|---|---|---|---|---|---|---|
| I | UF | 67 | 5,7 | 26,4 | 0 | ca. 500 | 75 | 1,35 |
| II | UF | 65 | 2,4 | 8 | 0 | ca. 500 | — | 1,35 |
| III | UF | 59 | 8,9 | 41 | 0 | ca. 500 | 90 | 1,35 |
| IV | MF | 116 | 3,7 | 14 | 0 | ca. 500 | 110 | 1,45 |
| V | UF | 81,6 | 8,5 | 35 | 2,08 | ca. 500 | 134 | 1,35 |
| VI | UF | 70 | 8,3 | 35 | 0,58 | ca. 500 | 92 | 1,35 |
| VII | UF | 62 | 10,9 | 56 | 0 | ca. 500 | 171 | 1,35 |
| VIII | UF | 28,4 | 8,8 | — | 0,30 | ca. 500 | 63,8 | 1,35 |

Table III lists the compositions of rubber mixtures which contain resin types I to IV and Table IV the most important properties of the rubber compositions obtained by the vulcanisation under optimum conditions of the corresponding rubber mixtures.

In addition, both these Tables also give particulars on rubber mixtures which are used according to U.S. Pat. No. 2,896,949 as material for the best conventional non-inflated tennis balls so far. These rubber mixtures contain reinforcing styrene/butadiene polymers with a very high styrene content.

In Table III, the figures are parts by weight. They denote at the same time percentages by weight, referred to the respective elastomer or elastomeric mixture, since this latter is always indicated with 100 parts by weight.

The rubber mixtures *a* to *e* are suitable for use as material for the non-inflated tennis ball according to the invention. On the other hand, rubber mixtures *w* to *z* represent materials according to U.S. Pat. No. 2,896,949 for the manufacture of noninflated conventional tennis balls. Rubber mixtures *a* to *e* have a satisfactory hardness, a good rebound behaviour and good dynamic values. The values of the dynamic final compression, which was determined with a Goodrich flexometer, are especially favourable.

A further number of rubber mixtures are manufactured on the basis of the recipes given in Table VI and by mixing in each time one of the aminoplast resins III to VIII. These mixtures are suitable for the manufacture of pressureless and inflated tennis balls, as will be described hereinafter in more detail.

Manufacture of urea/formaldehyde resin VII

First a condensation polymer (N) – G is manufactured as follows:

naphthalenesulphonic acid: $CH_20 = 1.5$ (molar ratio) 343.9 parts of commercial naphthalenesulphonic acid (substantially 2 acid, 5.82 gram-equivalents/kg of $SO_3H$) and 300 parts of 30% aqueous formaldehyde solution are condensed at 100°C.

| Hours at 100° C | Addition of parts $H_2O$ | $CH_2O$ reaction (%) |
|---|---|---|
| 4.5 | 100 | — |
| 21.5 | — | 55.8 |
| 42.0 | — | 66.7 |
| 64.0 | 10 | 74.4 |
| Yield | 686 parts | |
| solids content | 57.2% | |
| acid content | 3.00 gram-equivalents/kg | |
| dilutability with $H_2O$ | ∞ | |

The urea/formaldehyde resin VII is manufactured as follows: 180 parts of urea are dissolved in 150 parts of water, the solution is warmed to 70°C, 150 parts of 30% aqueous formaldehyde; solution are added, condensation is carried out for 30 mins. at pH 7 and 70°C and the condensation mixture is cooled to 50°C.

The resultant precondensate (V) is mixed at 50°C with a solution of the condensation polymer (N)-G and converted into a polymer gel. The solution contains 170 parts of water to 15.5 parts of condensation polymer (N)-G. Gel time: 26 sec., gelation pH: 2.1, m-gram-equivalents of $SO_3H$/mole of urea: 15.4.

The gel is kept for 2 hours at 65°C, comminuted, well stirred with 500 parts of water and adjusted with 2 normal NaOH to pH 7.5. The polymer is filtered off, dried overnight in a hot stream of air of 110°C and deagglomerated in a high-speed pinned or dowelled disc mill. A voluminous, white polymer powder is obtained. In addition, the following values are to be stated.

| | |
|---|---|
| Yield (in parts) | 237 |
| Specific surface area ($m^2/g$) | 62.0 |
| Agglomerates ($\mu m$) | 10.9 |
| Residual moisture (%) | 4.7 |

B. Tennis Balls

EXAMPLES 1 AND 2

Two non-inflated tennis balls are manufactured using rubber mixtures d and e (vide Table III), and the conventional procedure is followed. First, two pairs of hemispherical, hollow cups are manufactured (vulcanisation at 500 psi (35 $kg/cm^2$), 145°C, 4 mins.). The welding of the two cups to form a ball is carried out in the case of pressureless balls for 5 minutes at 145°C and of inflated balls for 8 minutes at 145°C. The textile layer is applied at 135°C (5 minutes). The two balls (Examples 1 and 2 ) are provided with a felt covering. The wall thickness of the rubber core is 4.4 mm, the diameter of the finished balls 60.7 mm. The ball containing mixture *d* corresponds to Example 1, that containing mixture *e* to Example 2.

The tennis balls according to Examples 1 and 2 are compared in Table V in respect of rebound and deformation behaviour with inflated and non-inflated balls of the prior art. The following picture emerges from the comparison. The known inflated balls of make D, which were packed in cardboard boxes, have a weak rebound of 134 cm. The rebound is at the limit of the permitted tolerances and diminishes further in the course of the game. In other respects these balls meet the fixed regulations at the commencement of the game. But the deformation is practically at the permitted limit and increases during the further use of the ball. These balls are therefore unusable after a short time.

The tennis balls of make D packed in pressurised containers have initially a rebound of 136 cm and satisfy the requirements in this respect. On the other hand, however, deformation and return deformation with values of 5.08 and 7.75 mm respectively are outside the permitted tolerance. These balls are initially too hard. Only in the course of a few weeks do they correspond fully to the prescribed regulations and exhibit a good play behaviour. But this condition only lasts for a relatively short time. Subsequently these balls assume the behaviour of those that were packed in cardboard boxes, which means that they are virtually unusable after a short time.

The known non-inflated tennis balls of make T have a too low rebound of 132 cm and in the first game are outside the permitted tolerances in respect of deformation and return deformation. They are initially too hard. After the first set the deformation and return deformation values change for the better so that they correspond to the standard specifications. But after a few further sets the return deformation increases and is finally outside the permitted limits. Furthermore, the rebound behaviour worsens simultaneously. The tennis balls of make T show strikingly large differences between deformation and return deformation. Right at the commencement of the game the values are 3.81 mm. After one set they increase to 4.45 mm. The player feels balls with such high differential values to be disagreeably sluggish and lacking in pep.

In contradistinction to the tennis balls of makes D and T discussed above, the tennis balls according to the invention of Examples 1 and 2 have an agreeable and relatively constant play behaviour. They comply fully with the regulations of the International Lawn Tennis Federation. In the differences between deformation and return deformation they come very close to the behaviour of the inflated balls. They are therefore felt by the player to be agreeably zippy. This favourable play behaviour remains virtually unchanged in the course of several games and also over a substantial period of time. This characteristic of the balls of Examples 1 and 2 represents an important advance over the known tennis balls.

EXAMPLES 3 TO 14

A further 12 balls are manufactured from the rubber mixtures or compositions *f* to *o*. The balls according to Examples 3 to 5 and 9 to 11 have atmospheric pressure internally, whereas all other balls have excess pressure as a consequence of benzenesulphohydrazide (propellant) having been introduced into the interior of the ball before the vulcanisation. Some of the balls have no textile covering, whereas others do have one. The ball according to Example 12 has a textile covering which was affixed to the shell with a polyurethane adhesive (based on isocyanate modified polyester-tris-pisocyanatophenylthiophosphate).

Table VII classifies the tennis balls and their properties. The ball characteristics are within the tolerances of the ILTF regulations. The following explanatory comments will serve to shed further light on the values reported in Table VII:

The tennis balls of Examples 3, 4 and 5 (pressureless with textile covering) have excellent behaviour in play. They also retain their good properties in extended play. The balls of Examples 6, 7 and 8 are very similar in their behaviour although the rubber composition of Example 8 contains more sulphur and less diethylene glycol than in the compositions of Examples 6 and 7 . The diferent pressure is attained by adding varying amounts of propellant (0.30 g, 0.50 g and 0.39 g). The balls of Examples 6, 7 and 8 are very agreeable in play. Balls 7 and 8 are especially lively, which is indicated by the high rebound. The ball of Example 6 proves especially good on a hard surface. Players of different disposition feel it to be agreeable (a noteworthy fact). A tennis ball of Example 6 (internal pressure 1.347 $kg/cm^2$ ) is punctured. After the gas has escaped and the pressure is adjusted to atmospheric pressure, the ball is sealed and then tested for its characteristics. The values are still within the tolerances of the regulations. The rebound drops from 138 cm to 134.6 cm. The Stevens deformation altered as follows: forward deformation from 0.255 to 0.275 inches, return deformation from 0.380 to 0.420 inches. This result must be regarded as surprising and permits the following conclusion to be drawn: tennis balls of the kind of Example 6 can have a very long "dual life". In their first life they behave like highly inflated balls, but in contradistinction to these they have a much longer and more agreeable behaviour in play. Then follows the second life in which the internal pressure very slowly falls and the values of the behavioural characteristics of the balls are still fully within the permitted tolerances. The tennis balls of Examples 9 to 11 are lively and agreeable in play. The values are within the permitted tolerances.

The tennis balls of Examples 12 to 14 have internal pressures of 1.450, 1.353 and 1.703 kg/cm² respectively. This adjustment is effected by filling the hollow core with the propellant "Porofor BSH" before the final vulcanisation in an amount of 0.3 to 0.5 g.

It is noteworthy that the ball of Example 12, which is provided with a textile covering affixed with a polyurethane adhesive, retains the internal pressure longer than conventional inflated textile covered tennis balls. On the other hand, the rebound is somewhat diminished. However, this means that in principle it is possible to correct the rebound of balls with too high a rebound by the use of the polyurethane adhesive.

Table I

Results of the deformation tests with the Stevens machine carried out on known commercially available tennis balls

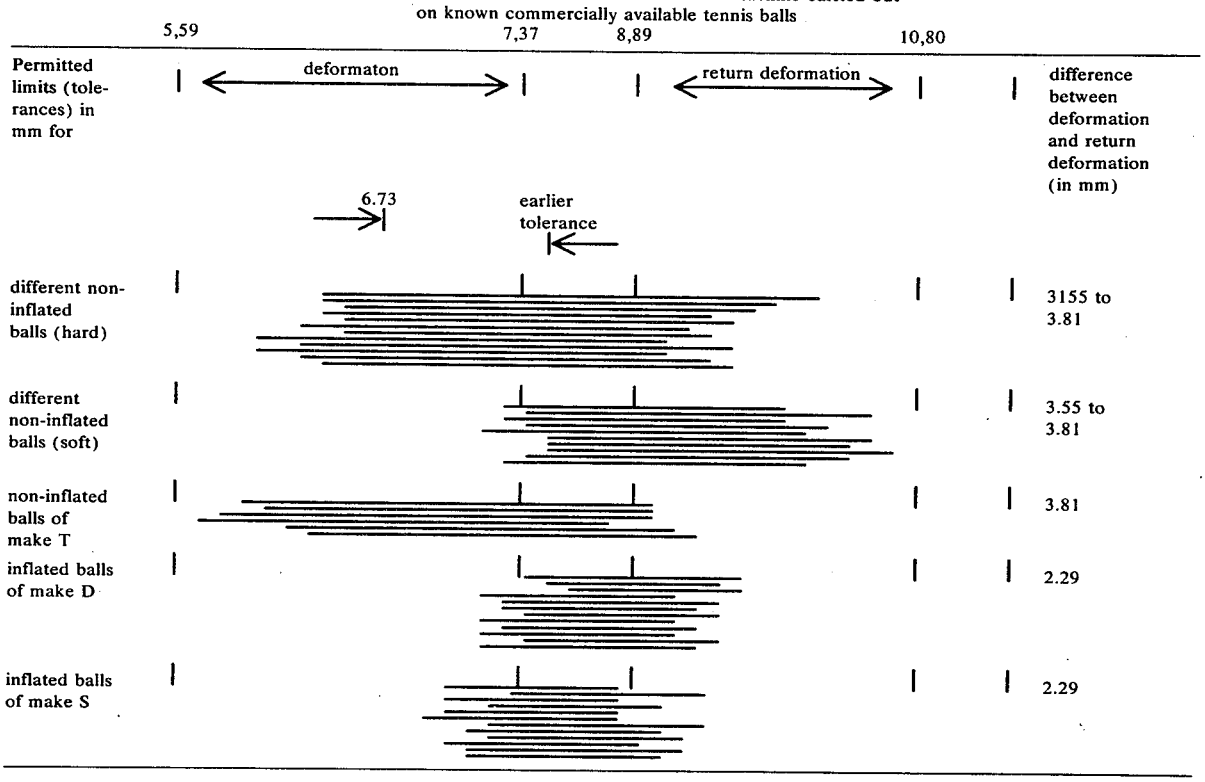

Table III

| Rubber Composition | a | b | c | d | e | w | x | y | z |
|---|---|---|---|---|---|---|---|---|---|
| natural rubber | 90 | 90 | 90 | 100 | 50 | 100 | 100 | 100 | 100 |
| polybutadiene | 10 | 10 | 10 | — | 50 | — | — | — | — |
| urea/formaldehyde I | 17 | 26 | | | | | | | |
| urea/formaldehyde II | | | 24 | | | | | | |
| urea/formaldehyde III | | | | 30 | 28 | | | | |
| melamine/formaldehyde resin IV | 12 | | | | | | | | |
| styrene/butadiene copolymer with 85% by weight styrene content (Pliolite S6H, reg. trademark of the Goodyear Tyre and Rubber Company) | | | | | | 29 | 35 | | |
| styrene/butadiene copolymer with 85% by weight styrene content (Goodrite 2007, reg. trademark of B.F. Goodrich Chemical Company) | | | | | | | | 29 | 32 |
| sulphur | 4,5 | 4,5 | 4.5 | 3.5 | 3.5 | 2.8 | 2.8 | 2.8 | 2.8 |
| stearic acid | 0.5 | 0.5 | 0.5 | 0.5 | 0.5 | 1 | 1 | 1 | 1 |
| zinc carbonate | 5 | 5 | 5 | 5 | 5 | 12 | 12 | 12 | 12 |
| dibutyl-p-cresol | 1 | 1 | 1 | 1 | 1 | | | | |
| zinc mercaptobenzimidazolate | 1 | 1 | 1 | 1 | 1 | | | | |
| N-isopropyl-N'-phenyl-p-phenylenediamine | 1 | 1 | 1 | 1 | 1 | | | | |
| diethylene glycol | 2 | 1.5 | 1.5 | 1.5 | 1.5 | | | | |
| N-cyclohexyl-2-benzthiazylsulphene amide | 0.8 | 0.8 | 1 | 0.8 | 0.8 | | | | |
| tetramethylthiuram disulphide | | | | 0.4 | 0.4 | | | | |
| zinc diethyl dithiocarbamate | 0.3 | 0.3 | 0.2 | | | | | | |
| Silan A 172 | | | | 1.5 | 1.5 | | | | |
| kaolin | | | | | | 8 | 8 | 8 | 8 |
| mercaptobenzthiazodisulphide | | | | | | 1.5 | 1.5 | 1.5 | 1.5 |
| diphenylguanidine | | | | | | 0.8 | 0.8 | 0.8 | 0.8 |

Table V

Comparison of the non-inflated tennis balls according to the invention with tennis balls of the prior art using the deformation tests with the Stevens machine

| permitted limits (tolerances) in mm for | deformation | return deformation | difference between deformation and return deformation (in mm) | rebound (in cm) |
|---|---|---|---|---|
| inflated balls of make D, test shortly after removal from the pressurised container | 5.08 – 7.75 | | 2.67 | 136 |
| the same balls from the cardboard box | 7.11 | 10.54 | 3.43 | 134 |
| non-inflated balls of make T, new and unused | 4.95 – 8.76 | | 3.81 | 132 |
| the same balls after 1 set | 5.72 | 10.16 | 4.45 | 130 |
| ball of Ex. 1, new and unused | 5.84 | 9.14 | 3.30 | 134 |
| the same ball after 1 set | 6.10 | 9.27 | 3.17 | 134 |
| ball of Ex. 2, new and unused | 5.97 | 9.02 | 3.05 | 140 |
| the same ball after 1 set | 6.22 | 9.14 | 2.92 | 140 |

Table VI

| Rubber Composition | f | g | h | i | j | k | l | m | n | o |
|---|---|---|---|---|---|---|---|---|---|---|
| light crepe natural rubber | 100 | 100 | 100 | 100 | 100 | 100 | 100 | 100 | 100 | 100 |
| u/f resin III | | | | | | 42 | | | | |
| m/f resin IV | | | | | | | | | | 35 |
| u/f resin V | 27,5 | | | | | | | | | |
| u/f resin VI | | | | | | | 30 | | 38 | |
| u/f resin VII | | 25,5 | | 25 | 15 | | | | | |
| u/f resin VIII | | | 35 | | | | | 50 | | |
| sulphur | 3,5 | 3 | 3,5 | 3,5 | 4,0 | 2,8 | 2,9 | 2,9 | 2,8 | 4,0 |
| stearic acid | 0,5 | 0,5 | 0,5 | 0,5 | 0,5 | 2 | 2 | 2 | 2 | 0,5 |
| zinc oxide | — | — | — | — | — | — | 5 | 5 | — | — |
| zinc carbonate | 5 | 5 | 5 | 5 | 5 | 5 | — | — | 5 | 5 |
| dibutyl-p-cresol | — | — | — | — | — | 1 | 1 | 1 | 1 | — |
| zinc mercaptobenzimidazolate | — | — | — | — | — | 1 | 1 | 1 | 1 | — |
| 2-α-methylcyclohexyl-4,6-dimethylphenol | — | — | — | — | — | 1 | 1 | 1 | 1 | — |
| N-isopropyl-N'-phenyl-p-phenylenediamine | 2 | — | 2 | 2 | 2 | — | — | — | — | — |
| phenyl-β-naphthylamine | — | 2 | — | — | — | — | — | — | — | 2 |
| kaolin | — | | — | — | — | — | 6 | — | — | — |
| diethylene glycol | 1,5 | 1,5 | 1,5 | 1,5 | 0,7 | 2,5 | 1,5 | 2 | 2,0 | 1,5 |
| N-cyclohexyl-2-benzthiazylsulphonamide | 0,8 | 0,8 | 0,8 | 0,8 | 0,8 | 0,8 | 0,8 | 0,8 | 0,8 | 0,8 |
| tetramethylthiuran disulphide | 0,4 | 0,4 | 0,4 | 0,4 | 0,4 | 0,2 | 0,4 | 0,4 | 0,4 | 0,4 |
| titanium(IV)oxide | — | — | — | — | — | 1,5 | 1 | 1 | 1 | — |
| yellow dye of Colour Index No. 21105 | — | — | — | — | — | 0,2 | 0,4 | 0,4 | 0,4 | — |
| aromatic substance based on ethyl vanillin | — | 0,03 | — | — | — | — | 0,05 | 0,05 | 0,05 | 0,03 |

We claim:

1. A tennis ball comprising a hollow sphere, which is optionally provided with a textile or felt covering and the weight, diameter, rebound and deformation behavior of which comply with the requirements of the Rules of the International Law Tennis Federation of 1972, which consists substantially of an elastomeric composition based on a natural rubber, a synthetic rubber or a mixture thereof, wherein the entire elastomeric composition, or at least a spherical annular layer thereof, contains in substantially homogeneous distribution 15 to 50 parts by weight of a finely powdered aminoplast resin with a specific surface area of > 5 $m^2/g$, to 100 parts by weight of the respective rubber or rubber mixture.

2. A tennis ball according to claim 1, wherein the rubber contains a urea/formaldehyde polycondensation product as the finely powdered aminoplast resin.

3. A tennis ball according to claim 2, wherein the rubber contains a urea/formaldehyde polycondensation product which consists of approximately spherical primary particles with an average diameter of < 1000 A, preferably of about 500 A, and wherein said urea/formaldehyde polycondensation product is present in the rubber partly in the form of agglomerates of the primary particles with average agglomerate particles sizes of up to 15 $\mu$m.

4. A tennis ball according to claim 3, wherein the average sizes of the agglomerate particles are up to 11 $\mu$m.

5. A tennis ball according to claim 1, wherein the rubber contains a melamine/formaldehyde polycondensation product as the finely powdered aminoplast resin.

6. A tennis ball according to claim 1, wherein the rubber contains a mixture of a urea/formaldehyde and a melamine/formaldehyde polycondensation product as the finely powdered aminoplast resin.

7. A tennis ball according to claim 1, wherein the rubber contains as the aminoplast resin a urea/formaldehyde condensation polymer which is modified by sulpho groups.

8. A tennis ball according to claim 7, wherein the urea/formaldehyde condensation polymer which is modified by sulpho groups contains napthalenesulphonic acid radicals, is highly disperse, consists of compact, spherical, agglomerated primary particles with a diameter smaller than 1 $\mu$m and has a specific surface area of 5 to 100 $m^2/g$, preferably 60 to 70 $m^2/g$.

9. A tennis ball according to claim 1, wherein the rubber contains an aminoplast resin with a specific surface area of 25 to 120 $m^2/g$, preferably of 30 to 120 $m^2/g$.

10. A tennis ball according to claim 1, wherein the rubber contains an aminoplast resin with a specific surface area greater than 50 $m^2/g$.

11. A tennis ball according to claim 1, wherein the aminoplast resin in the rubber is replaced to an amount of 30% by weight by a conventional filler for rubber, preferably by kaolin.

12. A tennis ball according to claim 11, wherein the rubber contains a urea/formaldehyde condensation polymer and kaolin in the weight ratio of about 6:1.

13. A covered tennis ball according to claim 1, wherein the rubber, or at least a layer thereof, contains 15 to 35 parts by weight of the respective aminoplast resin to 100 parts by weight of the respective rubber or rubber mixture.

14. An uncovered tennis ball according to claim 1, wherein the rubber, or at least a layer thereof, contains 30 to 50 parts by weight of the respective aminoplast resin to 100 parts by weight of the respective elastomer or elastomeric mixture.

15. A tennis ball according to claim 1, wherein the rubber contains only natural rubber as elastomer.

16. A tennis ball according to claim 1, wherein the rubber contains as elastomer a mixture of natural rubber and polybutadiene in the weight ratio of up to 50 parts of polybutadiene for 50 parts of natural rubber.

17. A tennis ball according to claim 1 having internally approximately atmospheric pressure.

18. A tennis ball according to claim 1 with an internal absolute pressure of approximately 1.4 to 2.3 $kg/cm^2$ (atmos.), preferably of 1.4 to 1.8 $kg/cm^2$ (atmos.).

19. A tennis ball according to claim 1 with a textile or felt covering.

20. A tennis ball according to claim 19, wherein the textile or felt covering is affixed to the rubber core with a polyurethane adhesive.

21. A tennis ball according to claim 1 without a textile or felt covering.

* * * * *